US008684789B2

(12) United States Patent
Gramelspacher

(10) Patent No.: US 8,684,789 B2
(45) Date of Patent: Apr. 1, 2014

(54) UNDERGARMENT

(76) Inventor: Olivia D. Gramelspacher, Chicago, IL (US)

( * ) Notice: Subject to any disclaimer, the term of this patent is extended or adjusted under 35 U.S.C. 154(b) by 331 days.

(21) Appl. No.: 13/160,024

(22) Filed: Jun. 14, 2011

(65) Prior Publication Data

US 2012/0322344 A1 Dec. 20, 2012

(51) Int. Cl.
*A41C 3/00* (2006.01)
*A41C 3/06* (2006.01)

(52) U.S. Cl.
CPC .. *A41C 3/065* (2013.01); *A41C 3/06* (2013.01)
USPC ..... 450/81; 450/92; 450/93

(58) Field of Classification Search
USPC ..... 450/1, 81, 39, 92, 93
See application file for complete search history.

(56) References Cited

U.S. PATENT DOCUMENTS

| | | | | | |
|---|---|---|---|---|---|
| 1,511,543 | A | * | 10/1924 | Wade et al. | 101/27 |
| 1,666,686 | A | * | 4/1928 | Chisholm | 139/420 R |
| 2,032,935 | A | * | 3/1936 | Hurt | 428/131 |
| 2,289,679 | A | * | 7/1942 | Porter | 450/57 |
| 2,359,804 | A | | 10/1944 | Struthers | |
| 2,420,575 | A | * | 5/1947 | Treadwell | 450/39 |
| 2,524,620 | A | * | 10/1950 | Cadous | 450/41 |
| 2,524,621 | A | * | 10/1950 | Cadous | 450/41 |
| 2,628,356 | A | * | 2/1953 | Rosenfield et al. | 450/41 |
| 2,830,298 | A | | 4/1958 | Shapiro et al. | |
| 2,940,454 | A | * | 6/1960 | Faron | 450/67 |
| 2,988,087 | A | * | 6/1961 | Krieger | 450/81 |
| 3,565,036 | A | | 2/1971 | Becker | |
| 4,413,626 | A | * | 11/1983 | Capasso | 450/74 |
| 4,557,267 | A | * | 12/1985 | Cole | 450/40 |
| 4,684,685 | A | | 8/1987 | Shuman et al. | |
| 4,704,745 | A | | 11/1987 | Reaver | |
| 5,643,043 | A | * | 7/1997 | Pflum | 450/86 |
| 5,885,910 | A | | 3/1999 | Graichen | |
| 6,146,239 | A | | 11/2000 | Magliocchetti | |
| 6,332,825 | B1 | * | 12/2001 | Henricksen | 450/81 |
| 6,446,268 | B1 | * | 9/2002 | Lazarian | 2/255 |
| 6,811,463 | B2 | | 11/2004 | Martz | |
| 7,409,728 | B2 | | 8/2008 | Harry | |
| 7,422,508 | B2 | * | 9/2008 | Bentham | 450/86 |
| 7,666,059 | B2 | * | 2/2010 | Falla et al. | 450/39 |
| 7,722,432 | B2 | * | 5/2010 | Wood et al. | 450/39 |
| 7,748,056 | B2 | * | 7/2010 | Mickle | 2/115 |
| 2009/0265832 | A1 | | 10/2009 | Clement | |

* cited by examiner

*Primary Examiner* — Gloria Hale
(74) *Attorney, Agent, or Firm* — Wood, Phillips, Katz, Clark & Mortimer

(57) ABSTRACT

An undergarment having a layer that is worn by being placed against a user's skin and has an exposed outer surface. The exposed outer surface has: a) a first area that has a first frictional characteristic; and b) a second area that has a second frictional characteristic. The first area of the exposed outer surface tends to resist sliding movement of an overgarment thereagainst more than the second area. The first area of the exposed outer surface tends to maintain a contacted surface of an overgarment releasably held against sliding movement along the first area of the exposed outer surface while the second area of the exposed outer surface allows a similar contacted surface of an overgarment to slide more readily along the second area of the exposed outer surface so as not to hang up.

22 Claims, 3 Drawing Sheets

UNDERGARMENT

BACKGROUND OF THE INVENTION

1. Field of the Invention

This invention relates to undergarments and, more particularly, to an undergarment with an exposed surface that has areas with different controlled frictional characteristics to maintain a desired relationship with an overgarment.

2. Background Art

The fashion industry has constantly contended with the problem of controlling the interaction of over- and undergarments. Undergarments generally are selected to engage specific areas of a user's body to provide support, to contour, and to provide a protective shielding layer. Overgarments function to strategically cover areas of the body and afford aesthetic enhancements, while additionally offering complementary support. Interaction of under- and overgarments often involves the matching of the marginal edges of the over- and undergarments so that body regions immediately adjacent those that remain exposed by the overgarments are supported by the undergarments. The design challenge, in this regard, is particularly significant in the upper torso of females, where overgarments are matched generally arealy to the undergarments at the marginal edges of bra cups and those of circumscribing and shoulder straps.

An example of the problem can be explained relative to the upper marginal edges of cups on a bra. These cups are made with varying degrees of plunge. Often, a high degree of frontal exposure is desired, which event the upper marginal edges thereof are lowered significantly. To take advantage of this plunging configuration, it is desired that the upper marginal edge of the overgarment be approximately matched to the cup edges in a manner whereby the overgarment does not project upwardly significantly beyond the marginal cup edges but at the same time blocks the undergarment edge from view.

The challenge to designers is particularly significant given the nature of the material making up the under- and overgarments. Overgarments, and particularly expensive categories thereof, are often made with materials that are in the very low friction category, such as silk, lace, satin, and other materials that produce a lightweight and potentially sheer configuration. While the undergarment may be made with a higher friction material, conventionally bras, corsets, bustiers, etc. are made with relatively low friction materials.

Oftentimes, women will rely upon the forces produced by circumscribing and shoulder straps to maintain the front of the overgarment pressed strategically against the frontal region to match the upper marginal edges of the bra cups and overgarment. To do this most effectively, the forces produced by the straps may have to be significant to the point that a certain level of discomfort is induced, which may also cause an undesired pressing and contouring of the underlying body region. Even if a substantial amount of pressure can be withstood without significant aesthetic compromise, circumferential and vertical force application generally will not allow for the desired conformity of the overgarment to the bra cups, particularly when there is substantial curvature.

In an attempt to deal with the above problems, particularly with a strapless construction, it is known to modify off-the-shelf undergarments and overgarments with mechanical fasteners. For example, straight pins and safety pins can be used to secure the under- and overgarments together at strategically selected locations. While this attempted solution has a degree of effectiveness in terms of controlling slippage between under- and overgarments, there are a number of inherent drawbacks associated with this approach.

First of all, it is difficult to completely mask the presence of the pin fasteners. Further, the pins have sharp regions that may press against or even puncture the skin of a user as the garments shift during normal activities. Further, use of pins requires penetration of fabrics. Garments often use very expensive and exotic fabrics that may be damaged by the use of such pins. Aside from the openings produced by the pins in the garments, each entry location produces a stress concentration that may cause a tear. This problem may be aggravated over time and through repetitive pinnings of the over- and undergarments. Further, it is difficult, inconvenient, and often impossible, to pin garments to effectively control their relationship without using a large number of pins. The objectives of maintaining a desired relationship between under- and overgarments and minimizing the number of pins required compete with each other. It may also be difficult to consistently pin garments, as a result of which the appearance thereof will vary significantly from one wearing to the next.

It is also known to use tapes, such as those that are double-sided to interact between under- and overgarments at their marginal edges. The use of such tape has a number of drawbacks as well.

First of all, tape with an adequately aggressive adhesive may have an undesired bulk/thickness that can be detected through an overgarment with the tape in place. The tape must also be applied for each wearing and removed once the wearing is concluded to avoid garment damage. Inadvertent release of adhesive through normal activities has led to many public garment "malfunctions." To avoid this problem, more aggressive adhesives may be utilized. By doing so, one risks that the tape will damage or destroy the over- and/or undergarments once removed. Further, adhesives generally depend upon there being a fixed engagement between the tape and each of the over- and undergarments. In the event that a force is applied to an overgarment generally perpendicular to the plane of the tape, separation may occur relatively easily. However, once the over- and undergarment are re-engaged, the adhesive may be compromised or totally ineffective as a result of which the tape performs little or no function. Aggressive adhesives may also leave unwanted residue on over- and undergarments. As with the pins, the use of tape requires potentially a time-consuming ordeal at the start of each wearing that may lead to inconsistent looks and effectiveness. Still further, the tape may be visible through sheer fabric making up the overgarment, which detracts from the overall appearance of an outfit. Additionally, tapes may utilize adhesives that cause allergic skin reactions and potentially even scarring.

It is also known to use hook-and-loop fastener components to cooperate between over- and undergarments. The problems associated with pins and tape are contended with as well by those using this type of fastener. Further, hook-and-loop fastener generally has a greater thickness that may produce a detectable discrete bulge. One also contends not only with the potential separation of the hook-and-loop fastener components from each other, but also detachment of the hook-and-loop fastener components from their respective garment. Permanent attachment of hook-and-loop fastener components may undesirably alter the associated garments. Repeated wearing and cleaning of the garments with the attached fastener components may also alter the properties thereof, whereby a wearer must decide whether to risk potential embarrassing separation of the under- and overgarments, attempt to remove the attached fastener without damaging the associate garment, or discard an entire garment.

Buttons or snaps may be used in place of hook-and-loop fasteners. The same problems described for hook-and-loop fasteners are contended with using buttons or snaps.

One proposed solution to some of the above problems is presented in U.S. Pat. No. 5,885,910, to Graichen. Graichen discloses the use of threads that contain silicone. The primary objective of using the silicone is to increase the coefficient of friction between undergarments and a wearer. While Graichen also discusses garment-to-garment interaction and the design therein would appear to address some of the problems noted above, it also introduces others. It appears that an overgarment would tend to adhere in the same manner to the entire area of the garment. As a result, the fabric of the overgarment is prone to snagging and bunching randomly on cups, straps, and any other surfaces of an undergarment. The only way to avoid this problem is to initially carefully apply the overgarment to the undergarment and repeat this operation potentially many times after the user moves and repositions, as would inevitably cause a certain degree of shifting. For example, if the front region of a garment shifts, the wearer may not be afforded the luxury of only pulling up the marginal edge, as to match the upper marginal edge of cups, but may also be required to separate and reapply regions thereunder and therearound.

Still another problem with the design in Graichen is that it would appear that the frictional properties of the garments may significantly alter over time through regular wear and washing. By weaving the silicone-containing threads, small pockets are created between the threads throughout the interwoven network. While these pockets are relatively shallow, they will inevitably tend to accumulate foreign material, such as lint. At a certain point, the pockets become filled in their upper regions and potentially occupy a significant areal extent that may significantly alter the overall frictional characteristics of the outer surface on the garment. This condition may ultimately lead to either the disposal of the garment or the need to take other measures, such as those described above, to maintain the desired relationship between under- and overgarments.

While at first glance the above problems appear capable of being easily resolved, they have persisted for many decades and to current day have resulted in many public embarrassments through unwanted exposure. These garment "malfunctions" are seen regularly in celebrity ranks in spite of the fact that celebrity wardrobes are often financed by designers and carefully monitored by support staff that are highly skilled wardrobe presenters and have at their disposal essentially unlimited resources to deal with these problems. Ideally, wearers would be allowed to identify the desired amount of body exposure and select corresponding over- and undergarments that would make this possible. Ideally, the over- and undergarments would be constructed so that they are capable of being reused without regular modification or maintenance. Still further, the over- and undergarments ideally would be capable of being consistently aligned with minimal inconvenience to produce a conforming and controlled relationship. The industry continues aggressively to seek designs that will effectively achieve the above objectives.

SUMMARY OF THE INVENTION

In one form, the invention is directed to an undergarment having at least one layer that is worn by being placed against a user's skin at a region with a complementary shape. The at least one layer has an exposed outer surface. The exposed outer surface has: a) a first area that has a first frictional characteristic; and b) a second area that has a second frictional characteristic. The first area of the exposed outer surface tends to resist sliding movement of an overgarment thereagainst more than the second area of the exposed outer surface. The first area of the exposed outer surface tends to maintain a contacted surface of an overgarment releasably adhered against sliding movement along the first area of the exposed outer surface, while the second area of the exposed outer surface allows a similar contacted surface of an overgarment to slide more readily along the second area of the exposed outer surface so as not to hang up and thereby accumulate or bunch at the second area of the exposed outer surface, away from the first area of the exposed outer surface.

In one form, the undergarment is a bra with first and second cups each having an upper marginal edge with a lateral extent. The first area of the exposed outer surface is at the upper marginal edges of the first and second cups.

In one form, the first area of the exposed outer surface has a coating that is applied to an underlying layer and cured.

In one form, the coating is silicone.

In one form, the first area of the exposed outer surface has a silicone film that is permanently integrated into the first and second cups.

In one form, the silicone film extends continuously over a majority of a running lateral extent of each of the first and second cups.

In one form, the silicone film is applied in discrete patches spaced laterally along a lateral extent of each of the first and second cups.

In one form, the first area is an elongate strip extending along the upper marginal edges of the first and second cups.

In one form, the first area of the exposed outer surfaces is a film that is permanently integrated into the first and second cups.

In one form, the elongate strip extends over substantially an entirety of a lateral extent of at least one of the first and second cups.

In one form, the first and second cups each includes a first layer that defines the second area of the exposed outer surface and a film is permanently applied to the first layer to define the first area of the exposed outer surface.

In one form, the strip has a continuous portion that extends over substantially the entire lateral extent of at least one of the first and second cups.

In one form, the strip has a plurality of adjacent discrete patches/portions that cooperatively extend over substantially the entire lateral extent of the at least one of the first and second cups.

In one form, the first and second cups are reinforced at the marginal upper edges of the first and second cups.

In one form, the first and second cups are defined by stacked layers under the strip.

In one form, there is no film such as the permanently applied film on the first layer on the first and second cups below the strip.

In one form, the first and second cups each has a vertical dimension and the film is applied over no more than a top third of the vertical dimension of the first and second cups.

In one form, the film is permanently integrated by being one of either: a) pre-formed and thereafter adhesively bonded to an underlying layer; and b) pre-formed and thereafter sewn in place.

In one form, the film is plastic or rubber.

In one form, the undergarment is one of a: a) bra; b) girdle; c) bustier; d) slip; e) brief; f) shirt; g) stocking; and h) camisole.

DETAILED DESCRIPTION OF THE PREFERRED EMBODIMENT

Figure 1:
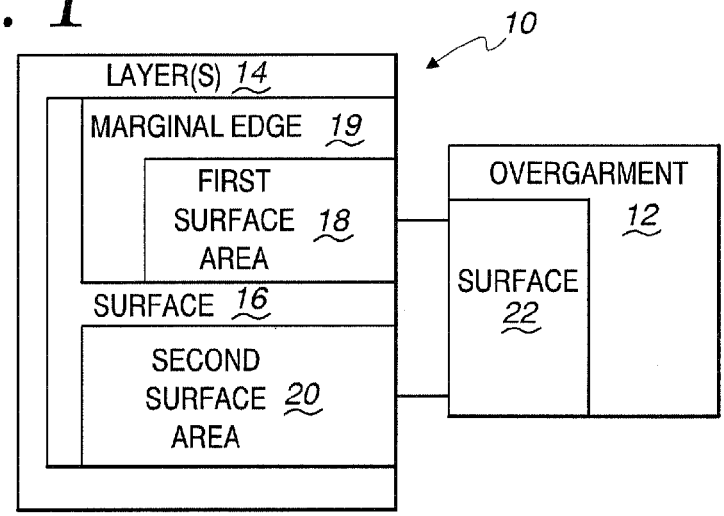
FIG. 1 is a schematic representation of an undergarment, according to the present invention, in combination with an overgarment that is worn thereover.

In FIG. 1, an undergarment 10, according to the present invention, is depicted schematically as it would cooperate with a conventional overgarment 12. The generic depiction of the undergarment 10 is intended to incorporate every conceivable undergarment that is worn by a user for support or coverage and that is in turn covered, partially or fully, by an overgarment. The undergarment may be, for example, one of a: a) bra; b) girdle; c) bustier; d) slip; e) brief; f) shirt; g) stocking; and h) camisole. The specific identification of these articles is not intended to be limiting and instead is presented to be all encompassing of undergarments, including those that may be conventionally identified with other terminology.

The undergarment 10 consists of at least one layer 14. The undergarment 10 is worn by placing the at least one layer 14 against a user's skin in a region with a complementary shape. The at least one layer 14 has an exposed outer surface 16 that has: a) a first area 18, with a marginal edge 19 that has a first frictional characteristic; and b) a second area 20 that has a second frictional characteristic. The first area 18 of the exposed outer surface 16 tends to resist sliding movement of the overgarment thereagainst more than the second area 20 of the exposed outer surface 16. More specifically, the first area 18 of the exposed outer surface 16 tends to maintain a contacted surface 22 of the overgarment 12 releasably held against sliding movement along the first area 18 of the exposed outer surface 16 while the second area 20 of the exposed outer surface 16 allows the same contacted surface 22 to slide more readily along the second area 20 of the exposed outer surface 16 so as not to hang up and thereby accumulate or bunch at the second area 20 of the exposed outer surface 16, away from the first area 18 of the exposed outer surface.

While, as noted above, the invention contemplates incorporation into any type of undergarment, the invention herein will be described specifically with respect to a bra. The function of the invention as incorporated into a bra is the same as for other undergarments and thus it is not necessary to separately describe the incorporation of the invention into these other undergarments.

Figure 2:
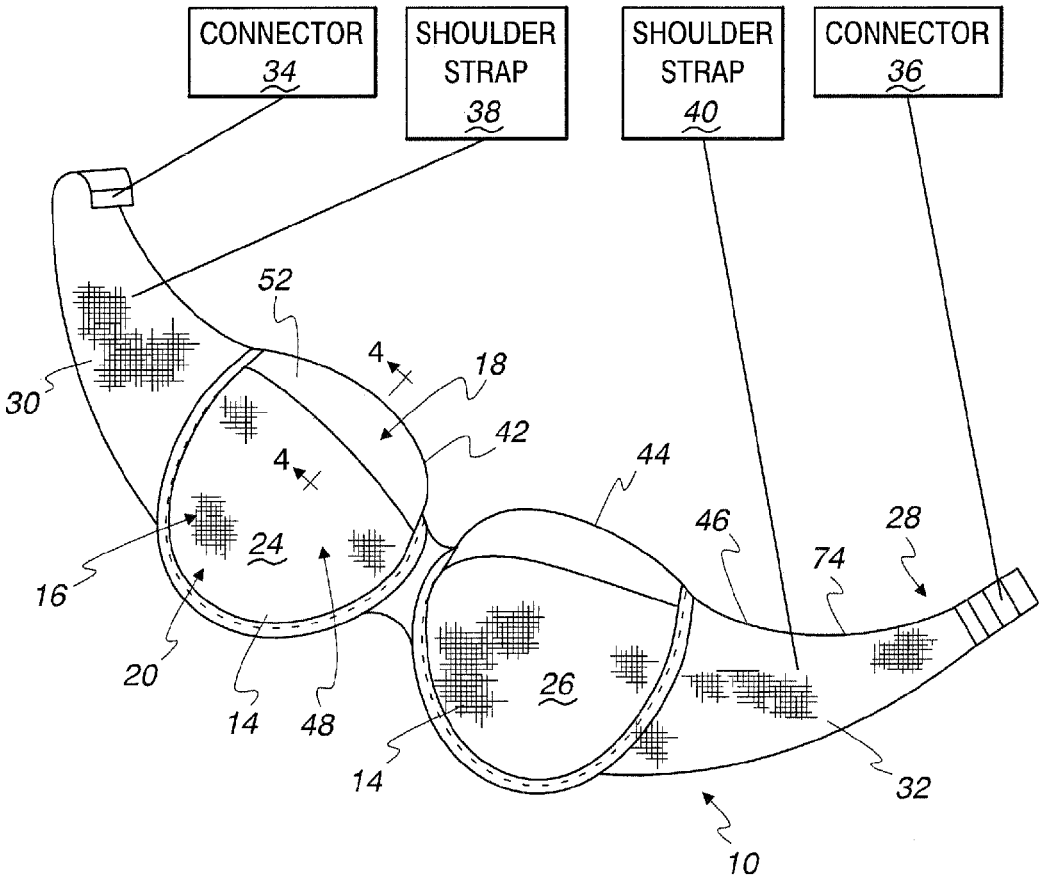
FIG. 2 is a perspective view one exemplary undergarment, as shown in FIG. 1 and in the form of a bra, with material incorporated therein to define separate areas with different frictional properties to strategically interact with an overgarment.

In FIG. 2, a bra 10 is shown with first and second cups 24, 26 with a circumferential strap at 28 consisting of strap parts 30, 32 having cooperating, releasable connectors 34, 36, respectively. The bra 10 may include shoulder straps 38, 40 but will be described herein without reference to such straps 38, 40.

The critical locations at which a relationship between the bra 10 and overgarment 12 is to be maintained is at the upper marginal edges 42, 44 of the cups 24, 26, and the top marginal edge 46 of the circumferential strap 28. The focus herein will be upon the upper marginal edges 42, 44 of the cups 24, 26.

The cups 24, 26, as mentioned above, are made with one or more layers 14 that define the cups 24, 26. The layer 14 has an exposed outer surface 48. The construction of the cup 24 will be described, with it being understood that the construction of the cup 26 is, although it is not required to be, the same.

The layer 14 may be made from conventional materials typically used in bra construction. It is common for these fabrics to be made from low friction materials, such as satin, silk, nylon, etc.

As seen in FIG. 2, the lower approximately two-thirds of the vertical dimension of the cup 24 has the material of the layer 14 directly exposed. This area of the exposed outer surface 16 is the aforementioned second area 20.

The upper one-third of the exposed outer surface 16 over the vertical extent of the cup 24 makes up the aforementioned first area 18. The first area 18 of the exposed outer surface 16 is thus at or closely adjacent to the upper marginal edge 42.

In this embodiment, the first area 18 is in the form of an elongate strip extending along the full lateral extent of the upper marginal edge 42, though this is not a requirement. Preferably, the strip form extends over at least a majority of the lateral extent of the upper marginal edge at each cup location.

Figure 3:
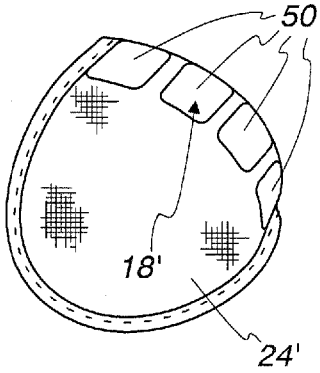
FIG. 3 is a perspective view of a modified form of one of the cups on the bra in FIG. 2.
Figure 4:
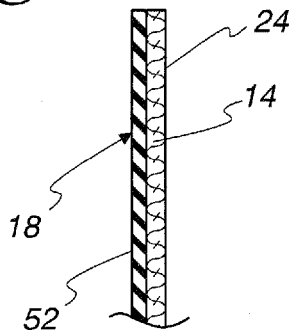
FIG. 4 is a cross-sectional view of the bra cup taken along line 4-4 of FIG. 2 and showing a film applied to an underlying layer.

While the strip form is shown as a contiguous component, it is also contemplated that the strip may be defined by two or more spaced patches or portions 50 that cooperatively make up a similarly functioning first area 18' on a similar cup 24', as shown in FIG. 3. That is, the portions 50 collectively produce a strip shape functioning like the continuous strip form shown for the first area 18 at FIG. 2.

The first area 18 may be defined by a film 52 integrated into the layer 14 that is immediately underlying. The film 52 is preferably permanently, or at least semi-permanently, integrated into the layer 14. The first area 18 of the exposed outer surface 16 may be smooth or alternatively may be textured to obtain the desired frictional properties.

This permanent integration may be effected by a number of different techniques. For example, the film 52 may be made from a material in the form of a coating that can be spread to a uniform thickness upon the layer 14 and subsequently cured to a set shape.

Figure 5:
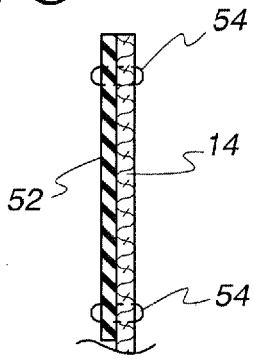
FIG. 5 is a view as in FIG. 4 showing an alternative manner of permanently incorporating a film into the bra cup.

In an alternative form, shown in FIG. 5, the film 52 might be pre-formed and thereafter permanently secured to the layer 14, as by one or more lines of stitching 54.

Figure 6:
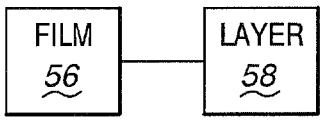
FIG. 6 is a schematic representation of an undergarment layer with a film permanently integrated thereinto.

The above are just representative ways to incorporate a film 14. In FIG. 6, a film 56 is shown in a schematic form integrated into a layer 58 in a permanent manner. The schematic showing is intended to encompass virtually any manner of integrating a film permanently into a layer 58 so that the film is exposed to define a first area on an exposed outer surface as hereinabove described.

As just one other example, the film 56 might be incorporated into a fabric layer 58 that is sewn to another fabric layer. The schematic showing in FIG. 6 is intended to encompass this construction and virtually any others that might be devised by one skilled in the art.

As a further alternative, discrete fasteners, such as studs (not shown) might be utilized to secure the film 56 permanently to the layer 58.

Figure 7:
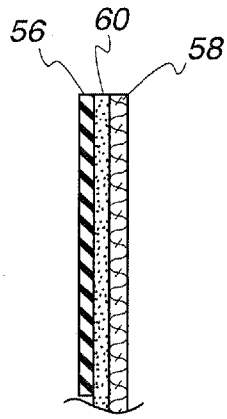
FIG. 7 is a view as in FIGS. 4 and 5 wherein an adhesive is used to permanently join a film with an underlying layer.

As a still further alternative, as shown in FIG. 7, the film 56 can be pre-formed and bonded to the layer 58 through an adhesive 60. The adhesive may be one that is required to cure or one that substantially retains its initial properties. In the former case, the curing may be time sensitive or induced by heat and/or pressure.

Figure 8:
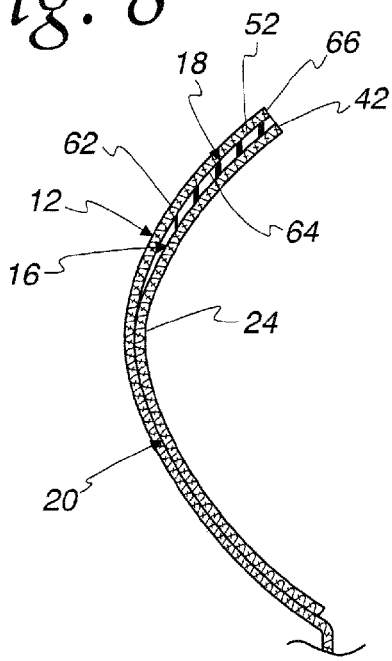
FIG. 8 is a cross-sectional view of one of the bra cups in FIG. 2 showing a portion of an overgarment interacting therewith.

As seen in FIG. 8, a layer 62 of the aforementioned overgarment 12 can be brought into contact with the first and second areas 18, 20 of the exposed outer surface 16. By initially spacing an inside surface 64 on the layer 62 from the exposed outer surface 16, an upper marginal edge 66 of the layer 62 can be aligned vertically with the upper marginal edge 42 of the cup 24, whereafter the surface 64 can be pressed against the exposed outer surface 16 of the cup 24. The interaction of the film 52 with the layer 62 causes the layer 62 to be maintained against vertical sliding along the first area 18 of the exposed outer surface 16 with enough tenacity that the layer 62 will not slide along the surface 16 during normal activities of the wearer.

Over the lower two-thirds of the vertical dimension of the exposed outer surface 16 on the cup 24, the surface 64 will slide freely along the second area 20 of the exposed outer surface 16 so as to smoothly conform to the cup contour below the film 52.

To maximize this conformity without hang-up or snagging of the layer 62 on the second area 20 of the exposed outer surface 16, preferably no film or other higher friction component, as makes up the first area of the surface 16, is applied to the area below the film 52.

Figure 9:
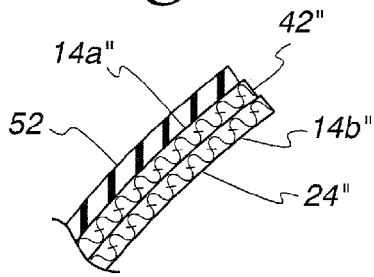
FIG. 9 is a view as in FIGS. 4, 5, and 7 and showing multiple layers stacked for reinforcement adjacent an upper marginal edge of a bra cup.
Figure 10:
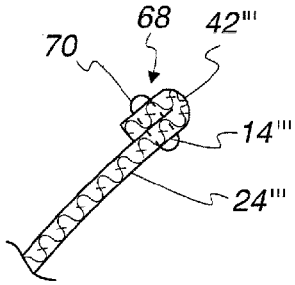
FIG. 10 is a view as in FIG. 9 wherein the layer is doubled against itself for reinforcement.

To assure that there is adequate rigidity and shape maintenance of the upper marginal edge of the cup 24, the upper marginal edge 42 thereon may be modified to be reinforced, as shown in FIGS. 9 and 10.

In FIG. 9, a modified form of cup 24" is shown with stacked layers 14*a*", 14*b*" that are coextensive at least at the upper marginal edge 42", where the film 52 resides, and potentially over the entire areal extent of the cup 24".

Alternatively, as shown in FIG. 10, a seam is formed at 68 where a layer 14" on the cup 24" is doubled back upon itself and secured as by stitching 70. A marginal edge 42" is defined at a bight location.

Figure 11:
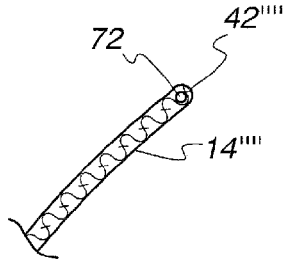
FIG. 11 is a view as in FIGS. 9 and 10 wherein a reinforcing element is incorporated into a layer.

As a further alternative, as shown in FIG. 11, a layer 14"" may be reinforced at its upper marginal edge 42" as through an embedded member 72, that may be a stiffening component made from metal, plastic, composite, etc.

As noted above, the second area of the exposed outer surface 16 may be made from materials conventionally used to construct bras. The material defining the first area of the exposed outer surface 16 is selected from a number of different readily available materials based upon its overall properties and is not limited to any specific composition.

The selection of the material for the first area is dictated by a number of parameters. First of all, the material must have the aforementioned frictional properties. That is, the material should grip the overgarment layer adequately that the overgarment layer will not slide vertically or horizontally during normal maneuvering with but a moderate pressure application between the overgarment layer and material. This may be accomplished with a high friction material or one that generates a slight adhering force. It is desirable, but not required, that the material release from an overgarment under a modest pressure application generally orthogonal to the contour of the exposed surface 16, whereby removal of the overgarment and re-placement of the same during a single wearing might be easily effected.

The material must be durable in the sense that it can maintain its basic properties even after being washed or cleaned with the undergarment.

The material must be flexible, with its required thickness and areal extent, so as not to significantly alter the flexibility of the undergarment, such as a bra.

The material should not leave any significant residue when separated from the overgarment.

Ideally, the material is non-toxic to humans and will not cause any skin reactions.

One suitable material that meets all of the above design parameters is silicone. Silicone, with respect to its frictional properties, may have a certain tackiness that is particularly desirable since it aids holding of the overgarment by generating nominal adhesion forces without creating residue when released from the overgarment.

As noted, silicone is but exemplary of a number of different materials that could be selected by one skilled in the art to afford the desired performance characteristics.

Other materials that might be adopted for use at the first area are vinyl, rubber, plastic, felted fabrics, textured fabrics, frictionalized fabrics, fabrics incorporating frictionalized threads, adhesive with a release capability that will not damage garments or leave residue, etc.

The material may be applied to produce a design that is exposed on the isolated undergarment. The design might be purely decorative in nature or might be informational in nature, such as to reproduce a company name or logo.

The inventive concept can be used on an undergarment at any location where it is desirable that adjacent areas of substantial extent are made with different frictional properties so that there is frictional holding that is greater in one area than in an adjacent area. For example, on the bra 10, the inventive concept might utilized additionally, or alternatively, at the upper marginal edge 74 on the circumferential strap 28.

It is conceivable, for example, that a first area might be below the second area, with it being an objective that a material would slide vertically relative to the second area and bunch or accumulate above the stationary first area.

Figure 12:
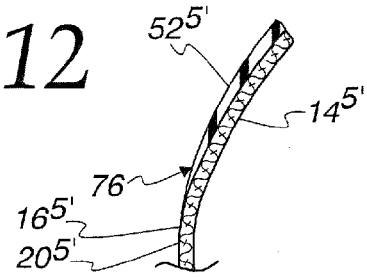
FIG. 12 is a view as in FIGS. 9-11 and showing a tapered transition location between a film and underlying layer.

The gripping material may be applied with a uniform thickness. As shown in FIG. 12, the film $\mathbf{52}^{5'}$ may be feathered at 76 where the lower portion of the film $\mathbf{52}^{5'}$ blends with the second area $\mathbf{20}^{5'}$ of the exposed outer surface $\mathbf{16}^{5'}$ of the layer $\mathbf{14}^{5'}$ to avoid identifiable bulges or edges at such a transition location.

The thickness may vary for other reasons as well, as for example to selectively rigidify portions of the undergarment.

The foregoing disclosure of specific embodiments is intended to be illustrative of the broad concepts comprehended by the invention.

The invention claimed is:

1. An undergarment comprising:

at least one layer that is worn by being placed against a region of a user's skin, the at least one layer having an exposed outer surface, the exposed outer surface having: a) a first area that has a first frictional characteristic; and b) a second area that has a second frictional characteristic, the first area of the exposed outer surface tending to resist sliding movement of an overgarment thereagainst more than the second area of the exposed outer surface, the first area of the exposed outer surface tending to maintain a contacted surface of an overgarment releasably held against sliding movement along the first area of the exposed outer surface while the second area of the exposed outer surface allows a similar contacted surface of an overgarment to slide more readily along the second area of the exposed outer surface so as not to hang up and thereby accumulate or bunch at the second area of the exposed outer surface away from the first area of the exposed outer surface, wherein the undergarment has first and second cups each having an upper marginal edge with a lateral extent and the first area of the exposed outer surface is at the upper marginal edges of the first and second cups, wherein the first area of the exposed outer surface comprises a coating that is applied to an underlying layer and cured.

2. The undergarment according to claim 1 wherein the coating comprises silicone.

3. The undergarment according to claim 1 wherein the first area of the exposed outer surface comprises a silicone film that is permanently integrated into the first and second cups.

4. The undergarment according to claim 3 wherein the silicone film extends continuously over a majority of a running lateral extent of each of the first and second cups.

5. The undergarment according to claim 3 wherein the silicone film is applied in discrete patches spaced laterally along a lateral extent of each of the first and second cups.

6. The undergarment according to claim 1 wherein the first area comprises an elongate strip extending along the upper marginal edges of the first and second cups.

7. An undergarment comprising:

at least one layer that is worn by being placed against a region of a user's skin, the at least one layer having an exposed outer surface, the exposed outer surface having: a) a first area that has a first frictional characteristic; and b) a second area that has a second frictional characteristic, the first area of the exposed outer surface tending to resist sliding movement of an overgarment thereagainst more than the second area of the exposed outer surface, the first area of the exposed outer surface tending to maintain a contacted surface of an overgarment releasably held against sliding movement along the first area of the exposed outer surface while the second area of the exposed outer surface allows a similar contacted surface of an overgarment to slide more readily along the second area of the exposed outer surface so as not to hang up and thereby accumulate or bunch at the second area of the exposed outer surface away from the first area of the exposed outer surface, wherein the undergarment has first and second cups each having an upper marginal edge with a lateral extent and the first area of the exposed outer surface is at the upper marginal edges of the first and second cups, wherein the first area of the exposed outer surfaces comprises a film that is permanently integrated into the first and second cups.

8. An undergarment comprising:

at least one layer that is worn by being placed against a region of a user's skin, the exposed outer surface having: a) a first area that has a first frictional characteristic; and b) a second area that has a second frictional characteristic, the first area of the exposed outer surface tending to resist sliding movement of an overgarment thereagainst more than the second area of the exposed outer surface, the first area of the exposed outer surface tending to maintain a contacted surface of an overgarment releasably held against sliding movement along the first area of the exposed outer surface while the second area of the exposed outer surface allows a similar contacted surface of an overgarment to slide more readily along the second area of the exposed outer surface so as not to hang up and thereby accumulate or bunch at the second area of the exposed outer surface away from the first area of the exposed outer surface, wherein the undergarment has first and second cups each having an upper marginal edge with a lateral extent and the first area of the exposed outer surface is at the upper marginal edges of the first and second cups, wherein the first area comprises an elongate strip extending along the upper marginal edges of the first and second cups, wherein the elongate strip extends over substantially an entirety of a lateral extent of at least one of the first and second cups.

9. An undergarment comprising:

at least one layer that is worn by being placed against a region of a user's skin, the at least one layer having an exposed outer surface, the exposed outer surface having: a) a first area that has a first frictional characteristic; and b) a second area that has a second frictional characteristic, the first area of the exposed outer surface tending to resist sliding movement of an overgarment thereagainst more than the second area of the exposed outer surface, the first area of the exposed outer surface tending to maintain a contacted surface of an overgarment releasably held against sliding movement along the first area of the exposed outer surface while the second area of the exposed outer surface allows a similar contacted surface of an overgarment to slide more readily along the second area of the exposed outer surface so as not to hang up and thereby accumulate or bunch at the second area of the exposed outer surface away from the first area of the exposed outer surface, wherein the undergarment has first and second cups each having an upper marginal edge with a lateral extent and the first area of the exposed outer surface is at the upper marginal edges of the first and second cups, wherein the first and second cups each comprises a first layer that defines the second area of the exposed outer surface and a film is permanently applied to the first layer to define the first area of the exposed outer surface.

10. The undergarment according to claim 8 wherein the strip has a continuous portion that extends over substantially the entire lateral extent of at least one of the first and second cups.

11. The undergarment according to claim 8 wherein the strip has a plurality of adjacent discrete portions that cooperatively extend over substantially the entire lateral extent of the at least one of the first and second cups.

12. The undergarment according to claim 1 wherein the first and second cups are reinforced at the marginal upper edges of the first and second cups by at least one of: a) stacking the one layer with another layer; b) doubling the one layer back on itself; and c) providing a stiffening component at the marginal upper edges of the first and second cups.

13. The undergarment according to claim 12 wherein the first and second cups are defined by stacked layers under the strip.

14. The undergarment according to claim 9 wherein there is no film such as the permanently applied film on the first layer on the first and second cups below the strip.

15. The undergarment according to claim 7 wherein the first and second cups each has a vertical dimension and the film is applied over no more than a top third of the vertical dimension of the first and second cups.

16. The undergarment according to claim 7 wherein the film is permanently integrated by being pre-formed and thereafter adhesively bonded to an underlying layer.

17. The undergarment according to claim 7 wherein the film comprises one of plastic or rubber.

18. The undergarment according to claim 1 wherein the undergarment is one of a: a) bra; b) girdle; c) bustler; d) slip; e) shirt; and f) camisole.

19. The undergarment according to claim 7 wherein the film is permanently integrated by being pre-formed and thereafter sewn in place.

20. The undergarment according to claim 7 wherein the undergarment is one of a: a) bra; b) girdle; c) bustler; d) slip; e) shirt; and f) camisole.

21. The undergarment according to claim 8 wherein the undergarment is one of a: a) bra; b) girdle; c) bustler; d) slip; e) shirt; and f) camisole.

22. The undergarment according to claim 9 wherein the undergarment is one of a: a) bra; b) girdle; c) bustler; d) slip; e) shirt; and f) camisole.

* * * * *

UNITED STATES PATENT AND TRADEMARK OFFICE

CERTIFICATE OF CORRECTION

PATENT NO. : 8,684,789 B2
APPLICATION NO. : 13/160024
DATED : April 1, 2014
INVENTOR(S) : Olivia D. Gramelspacher It is certified that error appears in the above-identified patent and that said Letters Patent is hereby corrected as shown below:

In the Claims

Column 11, lines 18-20 should read
18. The undergarment according to claim 1 wherein the undergarment is one of a: a) bra; b) girdle; c) bustier; d) slip; e) shirt; and f) camisole.

Column 11, lines 24-26 should read
20. The undergarment according to claim 7 wherein the undergarment is one of a: a) bra; b) girdle; c) bustier; d) slip; e) shirt; and f) camisole.

Column 11, lines 27-29 should read
21. The undergarment according to claim 8 wherein the undergarment is one of a: a) bra; b) girdle; c) bustier; d) slip; e) shirt; and f) camisole.

Column 11, lines 30-32 should read
22. The undergarment according to claim 9 wherein the undergarment is one of a: a) bra; b) girdle; c) bustier; d) slip; e) shirt; and f) camisole.

Signed and Sealed this
Second Day of September, 2014

Michelle K. Lee

Michelle K. Lee
*Deputy Director of the United States Patent and Trademark Office*